US008083661B2

(12) United States Patent
Garner et al.

(10) Patent No.: US 8,083,661 B2
(45) Date of Patent: Dec. 27, 2011

(54) CREASING MACHINE

(75) Inventors: Wilfred Macleod Garner, Leighton Buzzard (GB); Richard John Kelley, Wellingborough (GB)

(73) Assignee: Morgana Systems Limited, Milton Keynes (GB)

( * ) Notice: Subject to any disclaimer, the term of this patent is extended or adjusted under 35 U.S.C. 154(b) by 167 days.

(21) Appl. No.: 12/470,147

(22) Filed: May 21, 2009

(65) Prior Publication Data

US 2009/0291814 A1 Nov. 26, 2009

(30) Foreign Application Priority Data

May 22, 2008 (GB) ..... 0809340.3

(51) Int. Cl.
*B31B 1/25* (2006.01)

(52) U.S. Cl. ..... 493/396; 493/424; 493/355; 493/366

(58) Field of Classification Search ..... 493/10, 493/396, 399, 402, 416, 424, 355, 366–368, 493/403, 405
See application file for complete search history.

(56) References Cited

U.S. PATENT DOCUMENTS 4,765,604 A * 8/1988 Trogan ..... 270/39.09
4,854,147 A * 8/1989 Buckwitz et al. ..... 72/17.1
5,063,769 A * 11/1991 Retallick ..... 72/379.6
5,403,259 A * 4/1995 Parker ..... 493/352
6,604,444 B1 * 8/2003 Belanger et al. ..... 83/155
2003/0092551 A1 5/2003 Boss
2006/0229184 A1 * 10/2006 Powell ..... 493/467

FOREIGN PATENT DOCUMENTS

GB 2 373 759 10/2002

OTHER PUBLICATIONS

British Search Report for GB0809340.3 dated Aug. 2008.

* cited by examiner

*Primary Examiner* — Thanh Truong
(74) *Attorney, Agent, or Firm* — Fay Sharpe LLP

(57) ABSTRACT

A creasing machine (1) for forming creases in sheets (11) of flexible material, said creasing machine (1) including a creasing mechanism (5), a transport mechanism (3) for transporting sheets (11) of material through the creasing mechanism, and a control system (7) for controlling operation of the creasing mechanism (5) and the transport mechanism (3), said creasing mechanism (3) including first and second creasing members (25,27) and a drive mechanism (28) for driving the creasing members (25,27), wherein the creasing members (25,27) are arranged to move in the direction of movement of the sheet (11) and at least one of said creasing members (25,27) is moveable towards the other creasing member (25, 27) to produce a crease in a sheet (11) located between those members (25,27), and wherein the control system (7) is arranged to substantially match the speed of movement of the creasing members (25,27) with the speed of the sheet to enable the sheet to be creased while moving.

34 Claims, 15 Drawing Sheets

CREASING MACHINE

The present invention relates to a creasing machine and in particular, but not exclusively, to a creasing machine for use in the production and finishing of printed documents, and to a method of creasing sheets of flexible material.

When producing a folded document, it is generally preferable first to form a crease in the document. This produces a neat fold-line and it reduces the risk of cracking or tearing when the document is folded.

Conventionally, documents have been creased on a platen press or using a hand-operated machine with a rotating scoring wheel, which rolls across the surface of the document to produce the crease. However, it has been found that this system can lead to cracking of the printed surface, particularly with documents printed using modern ink or toner-based digital printing systems, or on easily damaged materials.

Further, existing creasing machines are either very slow (in the case of hand-operated machines) and therefore unsuitable for anything but very small production runs, or require the manufacture of a custom creasing die (in the case of platen presses), and are suitable therefore only for very large production runs.

One type of known machine uses a pair of creasing elements, wherein one of the creasing elements is arrange to move vertically towards the other to stamp sheets of paper located between the elements to form creases therein. The machine includes a paper feed system that positions the paper sheet between the creasing elements such that its movement is stopped for the creasing operation. Thus the paper is static when the creasing operation takes place and therefore the machine has a limited throughput. The paper has to be static in order for the creases to be formed otherwise the paper is torn and/or is crumpled.

Another known type of creasing machine includes a pair of rotary creasing blades having creasing formations formed therein. The blades rotate continuously in a synchronous manner about fixed axes and are arranged to receive sheets of paper in a nip formed between the blades. While this type of machine has been successful for the applications for which it was designed, it is not suitable for all creasing applications required by the creasing industry.

Accordingly the present invention seeks to provide a creasing machine that mitigates at least some of the aforesaid problem or at least provides an alternative thereto.

According to the present invention there is provided a creasing machine for forming creases in sheets of flexible material, said creasing machine including a creasing mechanism, a transport mechanism for transporting sheets of material through the creasing mechanism, and a control system for controlling operation of the creasing mechanism and the transport mechanism, said creasing mechanism including first and second creasing members and a drive mechanism for driving the creasing members, wherein the creasing members are arranged to move in the direction of movement of the sheet and at least one of said creasing members is moveable towards the other creasing member to produce a crease in a sheet located between those members, and wherein the control system is arranged to substantially match the speed of movement of the creasing members with the speed of the sheet to enable the sheet to be creased while moving.

The invention provides dynamic creasing of sheets of flexible material by providing creasing members that stamp creases into sheets dynamically by having at least one creasing member that is translationally moveable towards the other. This is an alternative arrangement to the rotary element dynamic creaser described above that does not suffer from the limitations described. In particular, the invention enables creases to be formed significantly closer together than the prior art device.

Advantageously the transportation system positively drives the sheet as it moves through the creasing mechanism.

Advantageously the first and second creasing members are arranged to move along curved paths. The first creasing member can include a first creasing formation and the drive system is arranged to drive the first creasing member such that it moves the first creasing formation along a substantially arcuate path. The second creasing member can include a second creasing formation and the drive system is arranged to drive the second creasing member such that the second creasing formation moves along a substantially circular or elliptical path. Preferably the curved path along which the second creasing formation moves is substantially within a vertical plane, thus the second creasing formation rises and falls in accordance with the movement of the drive system from a first position where it does not interfere with the sheet to a second position where it interferes with the sheet.

Advantageously the drive system can be arranged to move at least one of the first and second creasing members in a reciprocal manner, and preferably both creasing members.

Advantageously the drive system can be arranged to move the first and second creasing members such that the angular displacement of the first creasing member is matched to the angular displacement of the second creasing member. For example, the drive system can be arranged to rotate the first and second creasing members about pivots in opposite directions to substantially the same angular magnitude. This ensures that the creasing members move in the same linear direction. Preferably the first and second creasing elements can be connected together by a sliding pivot arrangement. The creasing elements have pins protruding from each longitudinal end and they are connected together by a linkage via the pins. The pins are located in slots formed in the linkage and are arranged for sliding movement therein.

Advantageously the drive system can be arranged to move the second creasing member from a start position wherein the separation between the first and second creasing members is at a maximum to a creasing position wherein separation between the first and second creasing members is at a minimum, and then back to the start position. In a preferred embodiment the minimum separation is achieved after the drive system has rotated an eccentric drive member through 180 degrees and the maximum separation is achieved after rotation the eccentric drive member through 360 degrees.

Advantageously the first and second creasing members can be pivotally mounted. Preferably one of the creasing members is arranged to pivot about a fixed pivot axis. For example, the first creasing member can be pivotally attached to a support frame by a fixed pivot pin. Advantageously at least one of the creasing members can be arranged to pivot about a movable pivot axis. This enables the creasing member to pivot and move translationally. For example, at least one of the creasing members can be pivotally attached to a support frame by a slidable pivot.

Advantageously the drive mechanism can include a variable speed motor, a drive crank and a pair of drive members mounted on the crank, wherein the drive crank is arranged to drive the first and second creasing members via the drive members. Advantageously the arrangement can be such that a single rotation of the drive crank moves the creasing elements from a start position through the creasing operation and then back to the start position. Preferably the crank includes two substantially circular cam members mounted eccentrically on a drive shaft. Each drive member is mounted on one of the cam members. Alternative shaped cam members can be used. The path along which the creasing formation moves is in part determined by the shape of the cam members.

Advantageously the variable speed motor can be an incrementally controllable motor such as a stepper motor, or a servo or DC motor having a suitable control system.

Advantageously each drive member can be attached to a frame member in a manner that allows it to rotate relative to the frame member and move translationally relative thereto. Advantageously the drive member can be attached to the frame member via a sliding pivot arrangement. The drive member includes a pivot pin located in a central portion that is located in a slot formed in the frame member. This enables the drive crank to drive the drive member in a pivoting translational manner.

In a preferred embodiment the creasing machine includes first and second frame members with the first and second creasing elements disposed there between. The first creasing element is elongate and is pivotally attached to first and second frame members at each end via fixed pivot pins. The second creasing member is elongate and is connected to each drive member in a central portion via dowels. For each drive member, the end remote from the crank engages with a guide member for the first creasing member, said guide member being pivotally attached to its respective frame member and slidingly pivotally attached to its respective drive member. Rotating the crank causes the lower ends of the drive members to be thrown outwards thereby causing the drive members to pivot about their sliding pivots within the frame members and the pivots to move vertically within their slots. This causes the second creasing member to move translationally and pivot. The creasing members are connected together by linkages. This causes the first creasing member to pivot with the second creasing member about its fixed pivot. The creasing members pivot to a maximum extent in a direction opposite to the movement of the sheet. Further rotation of the crank causes the creasing members to pivot in the opposite direction. As the crank continues to rotate the separation between the creasing members decreases. The control system locks the linear speed of the creasing members with the linear speed of the sheet just prior to forming a crease. The separation between the creasing elements reaches a minimum after one half of one rotation of the crank. At this time, the creasing members form a crease in the sheet, while the sheet is still being positively driven by the transportation system. Further rotation of the crank increases the separation between the creasing members and the control system uncouples the speed of the sheet from the speed of the creasing elements. The creasing elements then return to the home position.

Advantageously the control system can be arranged to match the speed of movement of the creasing members with the speed of the sheet for a period of movement and to control the speed of the creasing members and the sheet independently of each other at other times. This enables the creasing members and sheet to move at the same speed for the creasing operation and at other times to move at different speeds. This is advantageous because the control system can accelerate or decelerate the creasing members as required in order to ensure that they are correctly positioned to place a crease in the sheet in the required position. This is particularly useful for when a sheet requires a plurality of creases. The creasing members can be matched to the speed of the sheet for the period immediately before, during and immediately after the creasing operation and then the speed of the creasing members can be adjusted, for example speeded up significantly, in order for the creasing members to be repositioned ready to make a second or subsequent crease. The control system then locks the speed of the sheet with the speed of the creasing members when performing the second or subsequent crease. For example, the period of locking the speeds immediately before, during and after the creasing operation can be around 40 degrees of rotational movement of a drive crank.

Advantageously the drive system can include a sensor device for detecting when the creasing members are located at the home position. For example, the drive system can include an optical sensor for detecting a cut away portion of a disc mounted on the crank, a magnetic sensor, or any other suitable form of sensor, wherein the signals received form the sensor device are communicated to the control means to enable the control means to accurately calculate the length of any delays and/or the acceleration required in order to move the creasing elements to the creasing position to make the crease in the correct position on the sheet.

Advantageously the transportation system can include a transport drive motor and a pair of input rollers for transporting sheets of material through said creasing mechanism. Preferably the transport drive motor is a variable speed motor that can be incrementally controlled, for example the transport drive motor can be a variable speed stepper motor, or a servo or DC motor having a suitable control system. Advantageously the control means is arranged to control operation of the transport drive motor in order to match the speed of the creasing members with the speed of the sheet through a predetermined operating portion of the cycle wherein the creasing action takes place.

Advantageously the transportation system can include a sensor device for sensing the leading edge of a sheet as it passes from between said input rollers, wherein the control means is connected to the sensor device and is arranged to receive signals therefrom. For example, the sensor device can be an optical or ultrasonic sensor, or any other suitable type of sensor for sensing the leading edge of the sheet. When the sheet has been detected the position of the sheet within the creasing mechanism is always known by the control system since the control system controls the speed at which the sheet passes through the mechanism and is programmed with the distance between the point of detection and the creasing station.

The transportation system can include a pair of output rollers for removing sheets of material from said creasing mechanism. The input and output rollers are constructed and arranged to be driven synchronously.

Advantageously the control system is programmable, and is constructed and arranged to control the placing and number of creases produced by the machine according to predetermined requirements.

According to another aspect of the invention there is provided a method of creasing sheets of flexible material by using a creasing machine having a creasing mechanism including first and second creasing members and a drive mechanism for driving the creasing members, said method including transporting a sheet of flexible material to the creasing mechanism with a transport mechanism, controlling operation of the creasing mechanism and the transport mechanism with a control system such that the creasing members move in the direction of movement of the sheet and at least one of said creasing members moves towards the other creasing member to produce a crease in a sheet located between those members, and the control system substantially matches the speed of the creasing members with the speed of the sheet to enable the sheet to be creased while moving.

Advantageously the method can include moving the creasing members along curved paths. The first creasing member includes a first creasing formation and the method can include moving the first creasing formation along a substantially arcuate path. The second creasing member includes a second creasing formation and the method can include moving the second creasing formation along a substantially circular or elliptical path.

Advantageously the method can include moving at least one of the first and second creasing members in a reciprocal manner, and preferably both creasing members are moved in a reciprocal manner.

Advantageously the method can include moving the first and second creasing members such that the angular displacement of the first creasing member is matched to the angular displacement of the second creasing member.

Advantageously the method can include using a creasing machine that is arranged in accordance with any one of the configurations described herein.

An embodiment of the invention will now be described, by way of example, with reference to the accompanying drawings, in which.

Figure 1:
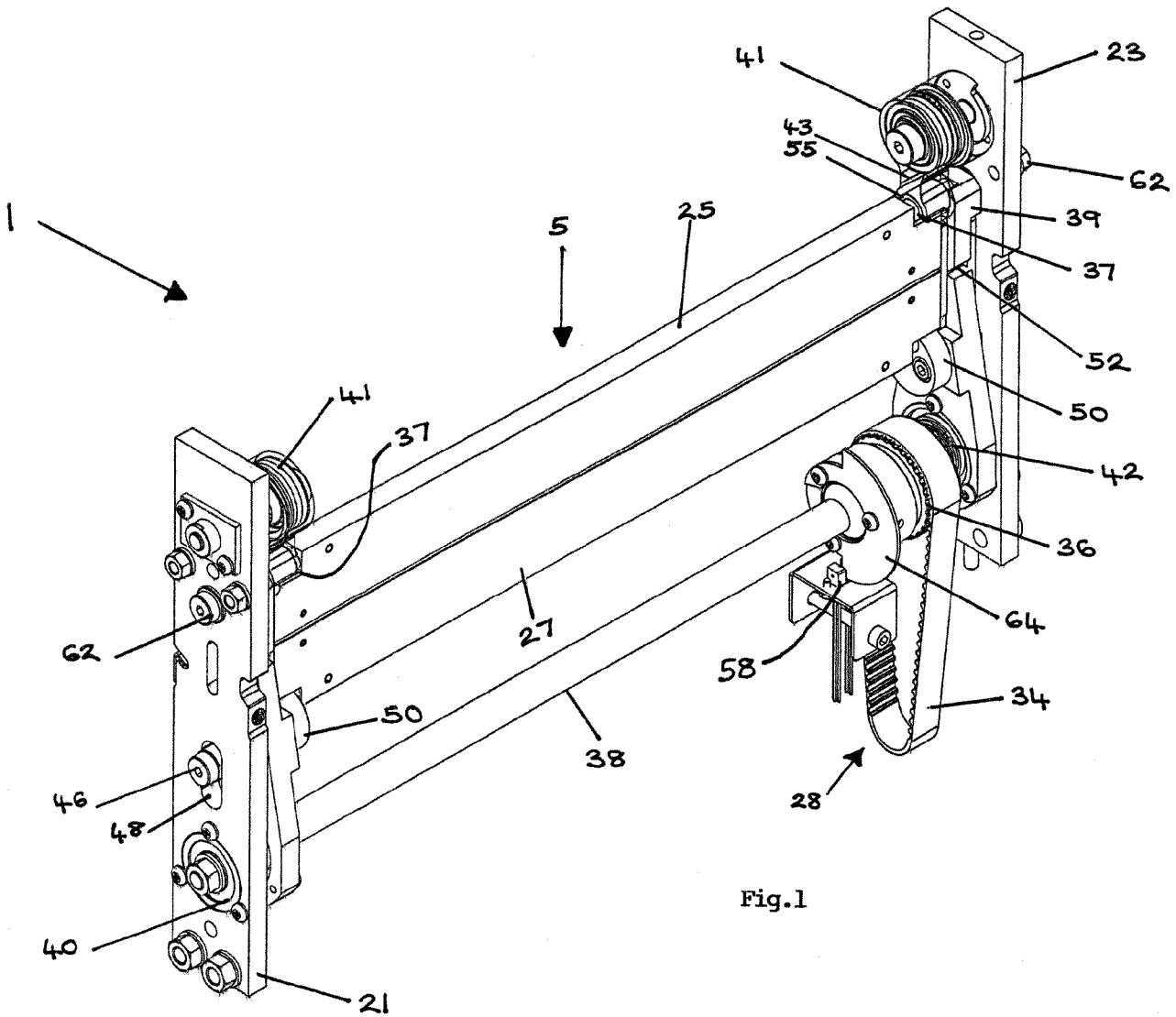
FIG. 1 is an isometric view of part of an assembled machine (the sheet transportation system is omitted for clarity)
Figure 2:
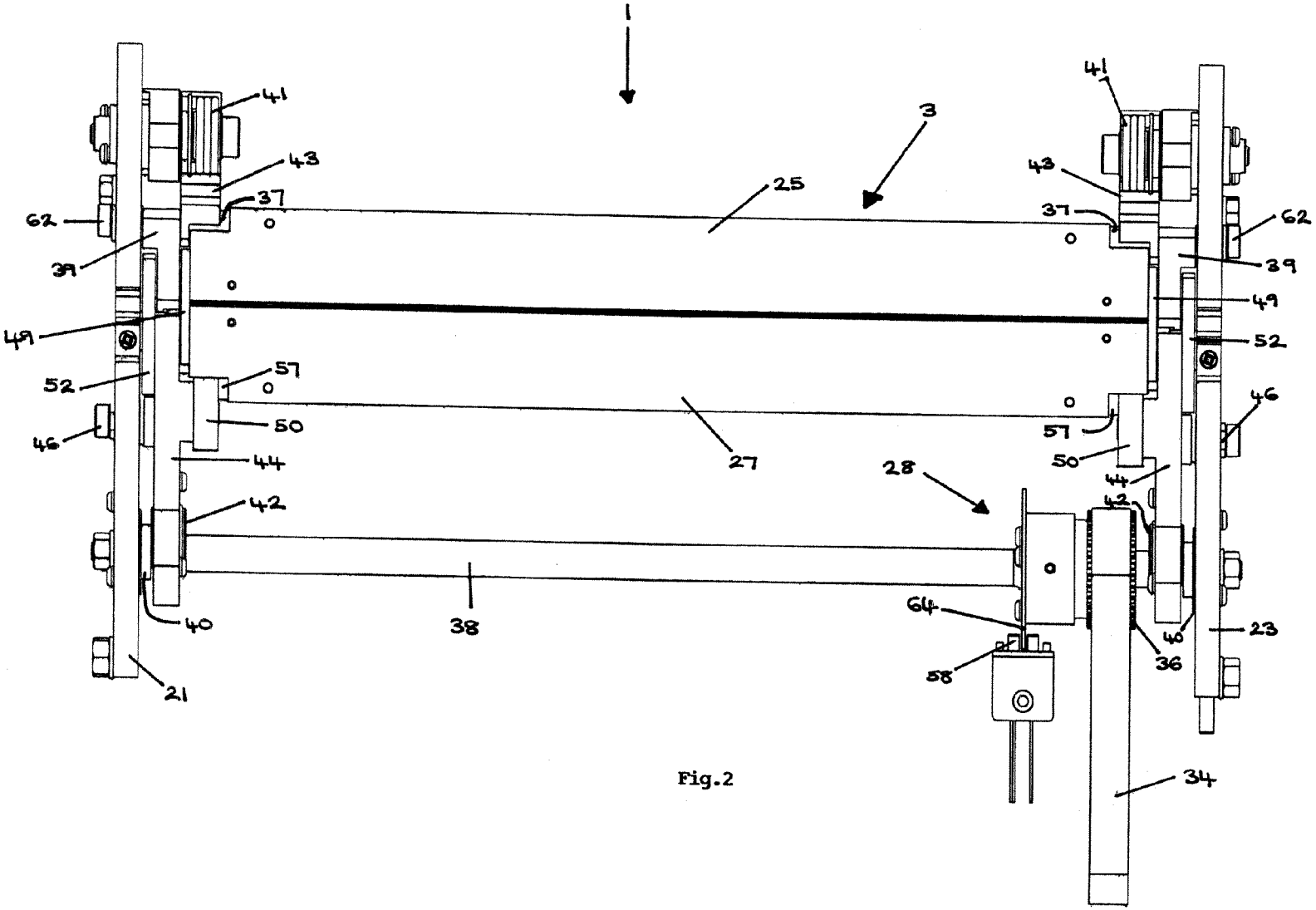
FIG. 2 is a front elevation of the part of the machine shown in FIG. 1.
Figure 3:
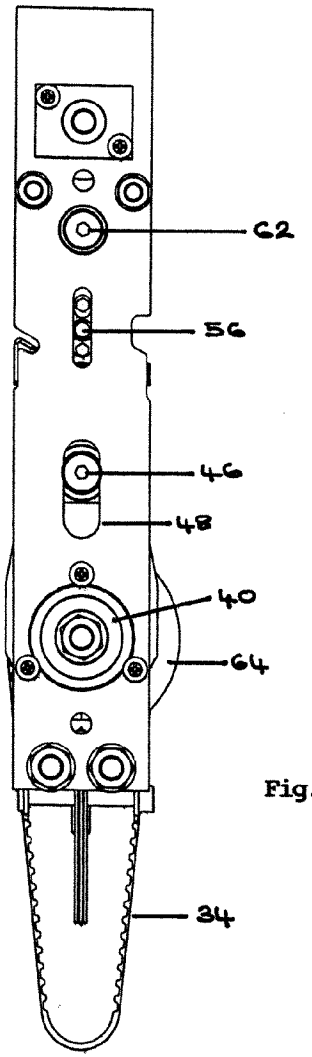
FIG. 3 is a side elevation of the part of the machine shown in FIG. 1.
Figure 4A:
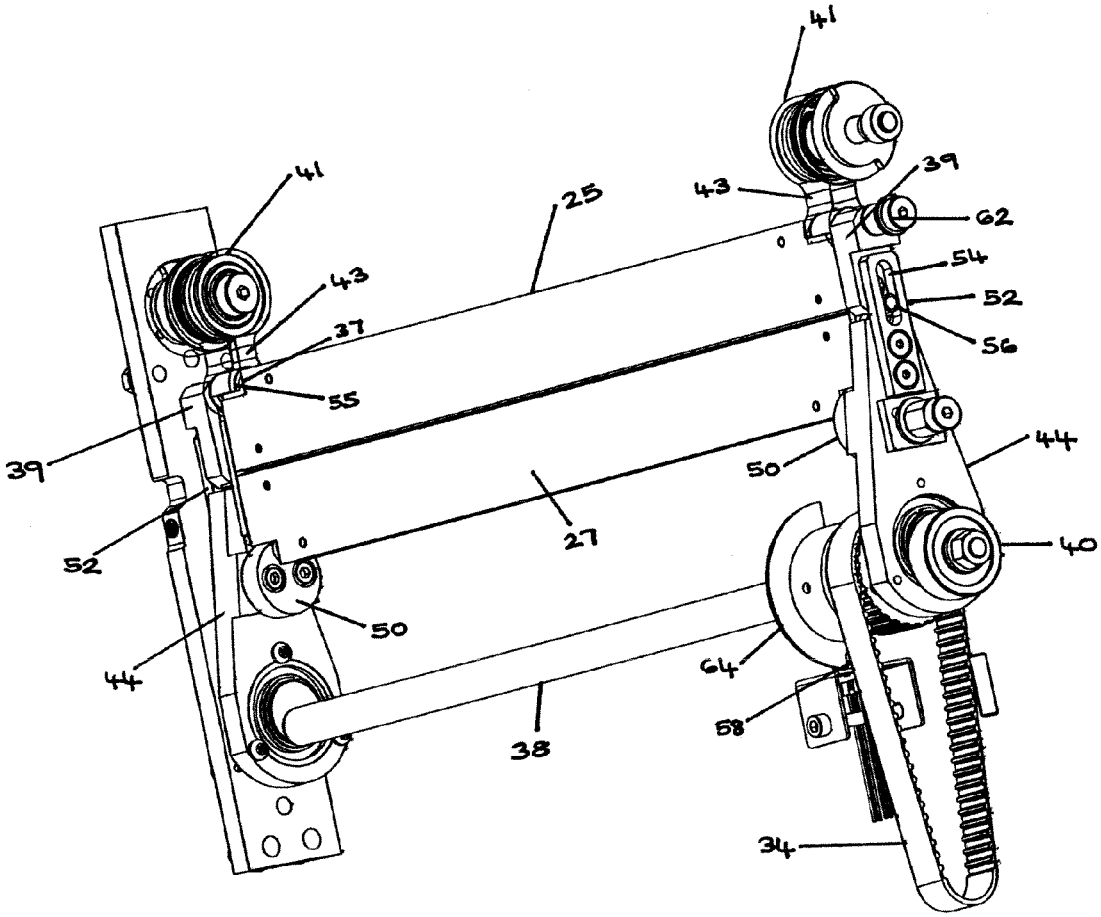
Figure 4B:
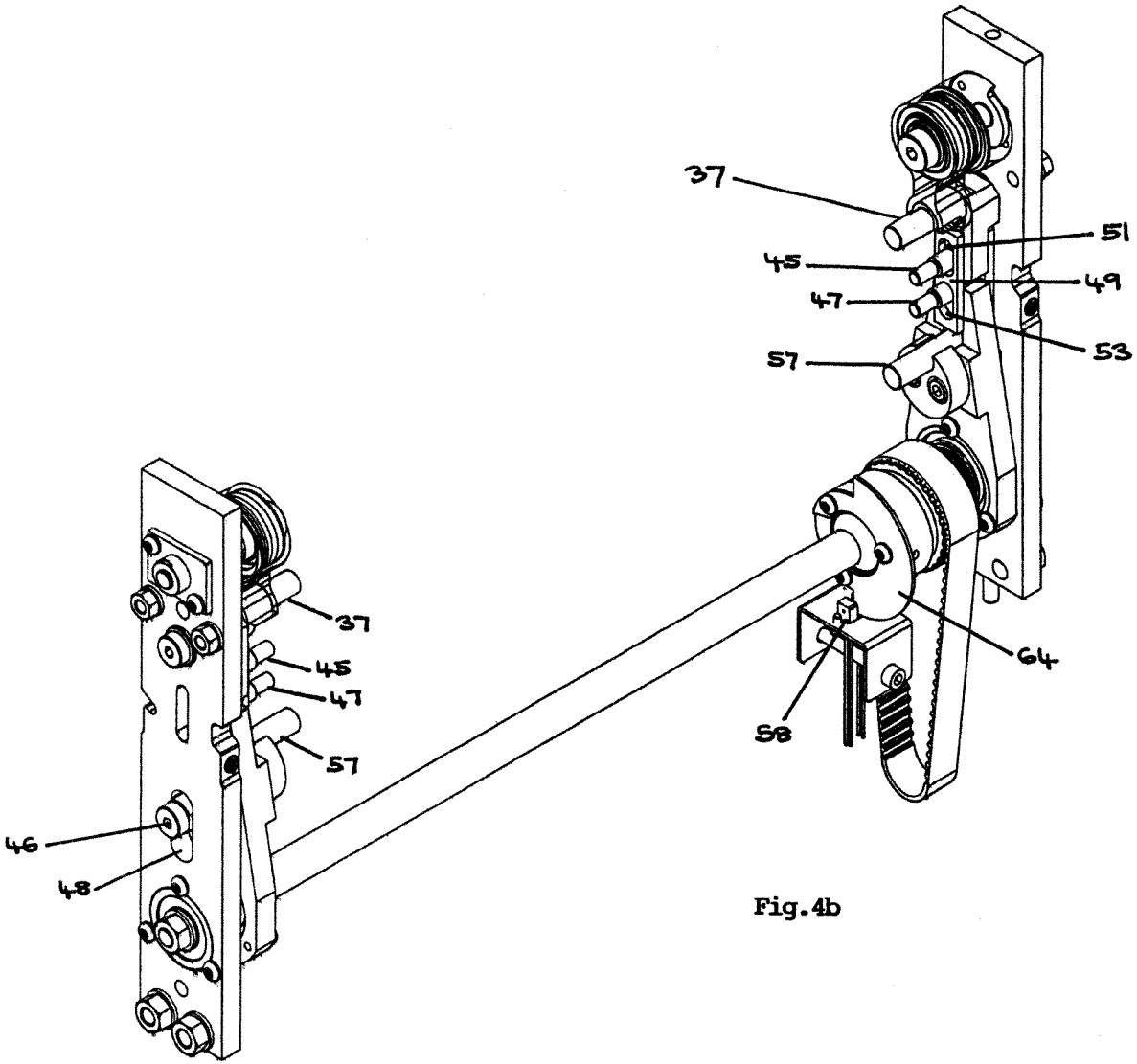
Figure 5:
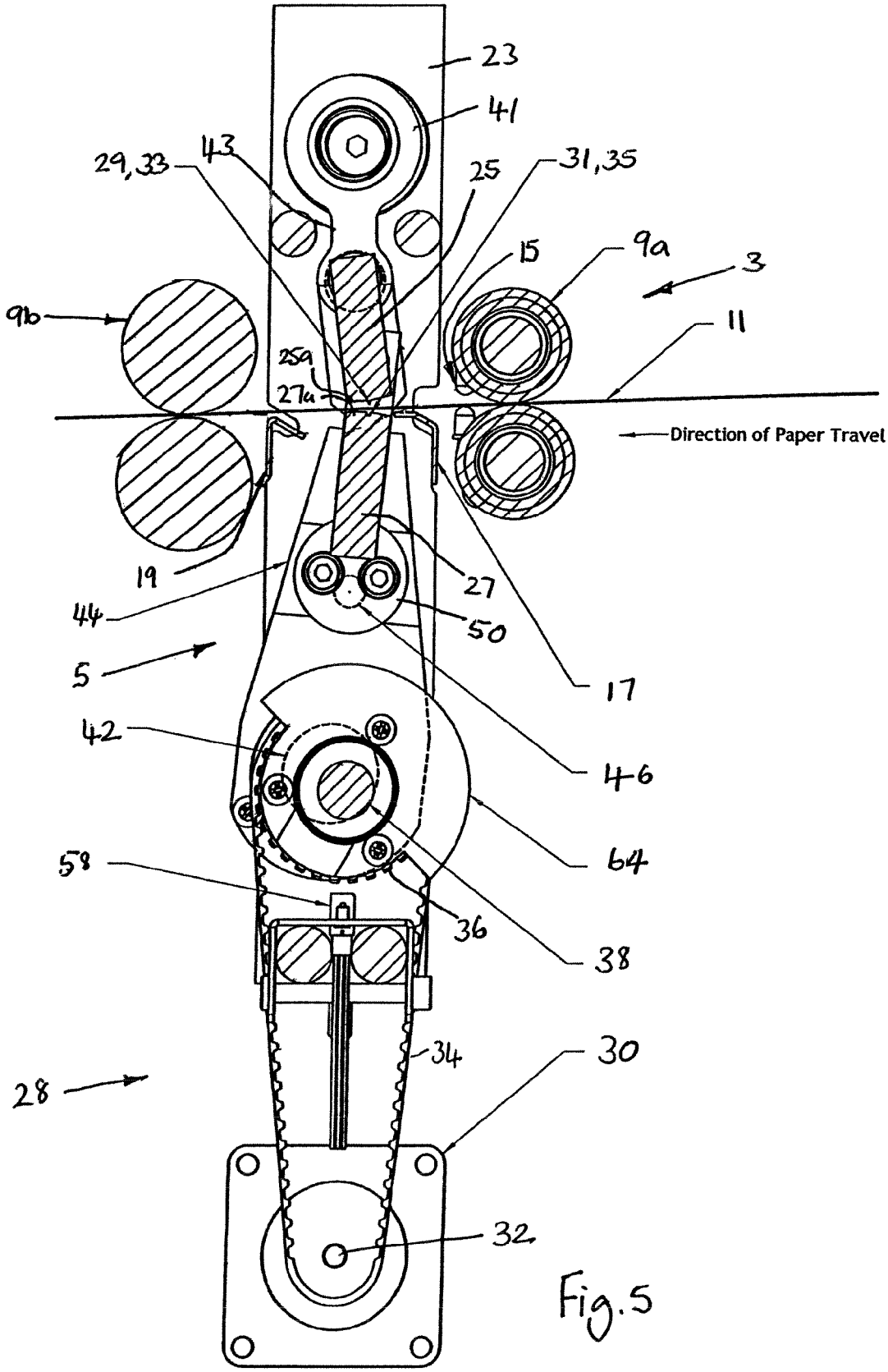
Figure 6:
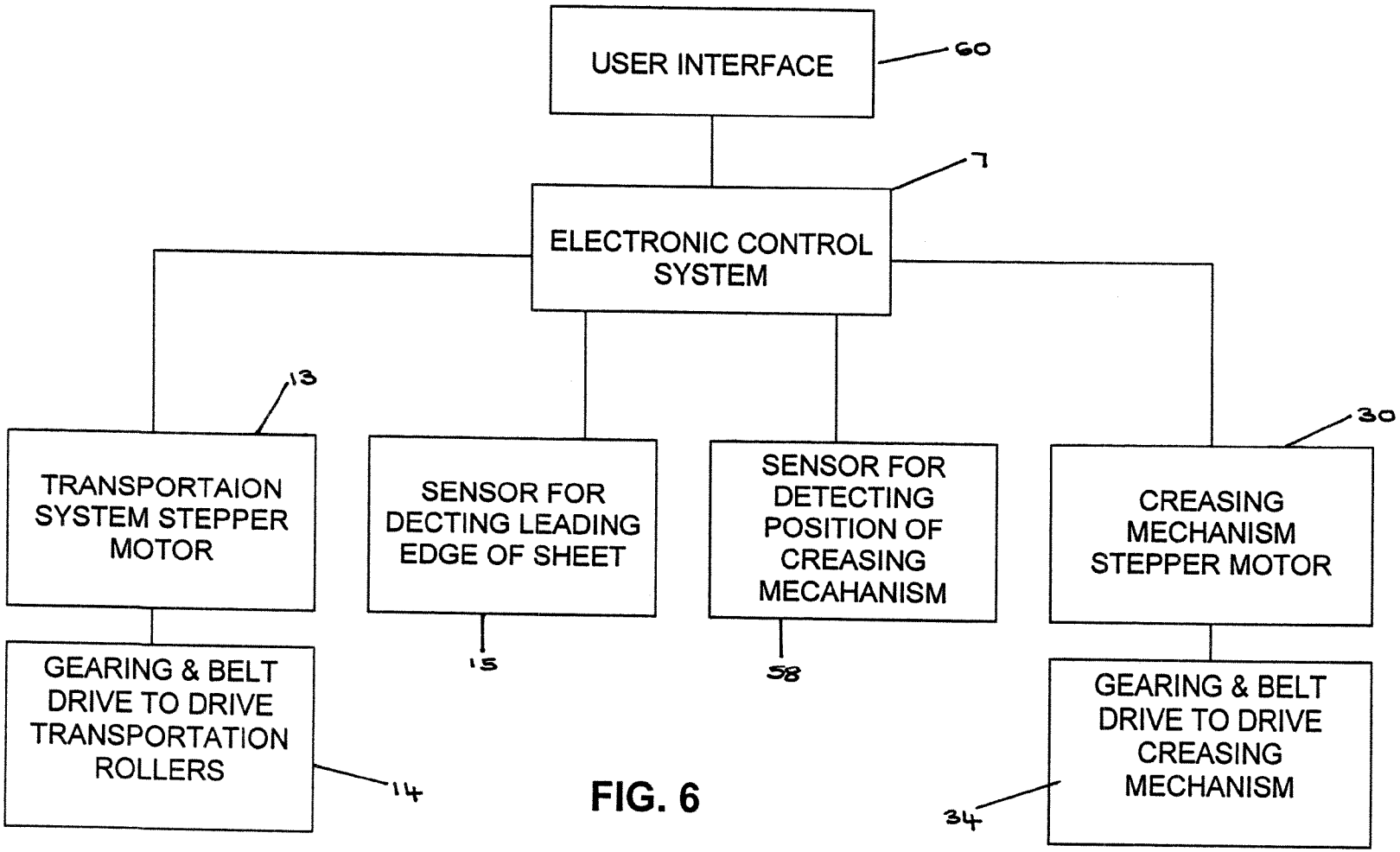

FIG. 4*a* is an isometric view of the part of the machine shown in FIG. 1 with components omitted for clarity, including a side frame member;

FIG. 4*b* is an isometric view of the part of the machine shown in FIG. 1 with components missing for clarity, including upper and lower creasing elements;

FIG. 5 is a sectional end view of part of an assembled machine showing components of the creasing mechanism and part of the sheet transportation system;

FIG. 6 is system level schematic; and

FIGS. 7 to 14 are sectional end views of part of an assembled machine, which show the movement of the creasing elements, rocker arms and cam drive system during a creasing operation.

FIGS. 1 to 6 show a document creasing machine 1 in accordance with the invention, which includes a sheet transportation mechanism 3, a creasing mechanism 5 and a microprocessor control system 7 for controlling operation of the transportation and creasing mechanisms 3,5.

The transportation mechanism 3 includes a pair of input rollers 9*a* and a pair of output rollers 9*b* that are arranged to transport a sheet 11 of flexible material such as paper, card or a plastic film, along a feed path through the creasing mechanism 5 (see FIG. 5). Both pairs of rollers 9*a*,9*b* are driven by a variable speed stepper motor 13 through a step-down gear and a belt drive 14, which is arranged such that the input and output rollers 9*a*,9*b* all rotate synchronously (see FIG. 6). Alternatively, an incrementally controllable servo or DC motor can be used together with a suitable controller.

A through beam infrared sensor 15 is arranged just behind the nip of the input rollers 9*a* to detect the leading edge of a sheet 11 passing between those rollers 9*a* (see FIG. 5). By sensing the leading edge of the paper, and controlling the operating speed of the stepper motor 13, and hence the input rollers 9*a*, the microprocessor control system 7 is able to monitor the exact position of the sheet 11 of paper as it passes through the creasing mechanism 5. Alternative sensors can be used for detecting the leading edge of the sheet, including non-through beam infrared sensors, optical sensors other than infrared sensors, ultrasonic sensors or any other suitable type of sensor for detecting the leading edge of the sheet.

Sheet input and output guides 17,19 are mounted on side frame members 21,23 to ensure that the sheet 11 travels along its intended path through the creasing mechanism 5. The input guide 17 is particularly useful for preventing very flexible sheet materials from colliding with the creasing mechanism 5 in an unintended manner.

The creasing mechanism 5 includes upper and lower creasing elements 25,27 and a drive system 28 for operating the creasing elements 25,27 to produce creases in the sheet 11. The creasing mechanism 5 is arranged such that it can crease the sheets 11 dynamically, that is a crease can be formed while the sheet 11 is moving through the creasing mechanism 5. This is achieved by having creasing elements 25,27 that are arranged to move with the sheet 11 during the creasing operation, and in particular creasing elements 25,27 that move at a speed that is matched with feed speed of the sheet 11 during the creasing operation. The means by which this is achieved is described in detail below.

The creasing mechanism drive system 28 includes a variable speed stepper motor 30 (see FIG. 5) having an output shaft 32 connected to a first spur gear (not shown). Alternatively, an incrementally controllable servo or DC motor can be used together with a suitable controller. The first spur gear drives a belt 34, which in turn drives a second spur gear 36 mounted on a drive shaft 38 supported by bearings 40 mounted in the side frames 21,23. Towards each end of the drive shaft 38 a circular cam member 42 is eccentrically mounted thereon and is arranged to rotate with the drive shaft 38. A rocker arm 44 is rotatably mounted on each eccentric cam 42. Each rocker arm 44 is pivotally attached to its respective side frame 21,23 via a sliding pivot pin 46 located in a slot 48 in its respective side frame member 21,23. Each pivot pin 46 is located on a central portion of the rocker arm 44 and is arranged to slide within its slot 48 according to the driving action of the eccentric cam 42. Thus each rocker arm 44 pivots and moves translationally in a reciprocal fashion when driven by its eccentric cam 42 in one rotational direction. The rocker arms 44 are supported by bearings 50.

Each rocker arm 44 is connected to an upper guide member 39 via a connector member 52. Each upper guide member 39 is pivotally attached to its respective side frame 21,23 towards its upper end via a pin 62 and includes a sliding pivot pin 56 towards its lower end. Each connector member 52 is fixed to its rocker arm 44 towards its lower end and includes a slot 54 for receiving the sliding pivot pin 56. The arrangement is such that rocker arm 44 drives the upper guide member 39 in a reciprocating pivoting fashion but is able to move translationally relative thereto since the sliding pivot pin 56 can move freely in the slot 54.

The creasing elements 25,27 are mounted between the input and output rollers 9*a*,9*b*, the upper creasing element 25 is mounted for limited pivoting movement and the lower creasing element 27 is mounted for limited pivoting and translational movement. In the arrangement shown in FIG. 5, the upper creasing element 25 includes a blade 29 and the lower creasing element 27 includes an anvil 31. The positions of the blade 29 and the anvil 31 can however be reversed. Both creasing elements 27,29 comprise elongate metal bars having a substantially rectangular cross-section, the blade 29 having a profiled rib 33 on its lower edge and the anvil 31 having a profiled recess 35 on its upper edge into which the rib 33 fits. The profile of the rib 33 and the recess 35 can be changed, according to the desired form of the crease. The upper surface 27*a* of the lower creasing element is arcuate so that it does not interfere with the sheet 11. The lower surface 25*a* of the upper creasing element is chamfered.

The upper creasing element 25 is pivotally attached to the side frame members 21,23 at each end via a pivot pin 37 and an adjuster device 38, which is arranged to enable the gap between the creasing elements to be adjusted to account for different thicknesses of sheet material. The pivot pins 37 are located towards the upper part of the creasing element 25 and are aligned substantially parallel to the longitudinal axis of the upper creasing element 25. Each adjuster device 41 includes a cradle 43 for supporting a pivot pin 37 such that the creasing element 25 depends therefrom in a manner that enables it to pivot relative to the side frame members 21,23. The cradle 43 includes a bush 55 for providing a smooth pivoting action.

The lower creasing element 27 is attached to each of the rocker arms 44 towards its lower end via dowel pins 57 the arrangement being such that the lower creasing element is fixed to the rocker arm 44 and moves pivotally and translationally therewith.

Each end of the upper creasing element 25 includes alignment pins 45, which are located towards the lower part. Similarly, each end of the lower creasing element 27 includes alignment pins 47 towards its upper part. The upper and lower creasing elements are connected together at each end by an alignment member 49. Each alignment member 49 comprises a substantially rectangular plate having upper and lower slots 51,53 formed therein, for receiving the alignment pins 45 and 47 respectively. The alignment pins 45 are arranged to extend through the upper slot 51 and into a recess formed in the upper guide member 39 and the alignment pins 47 are arranged to extend through the lower slots into recesses formed in the rocker arms 44. The arrangement is such that the pivoting movement of the upper and lower creasing elements is locked such that they pivot. Drive is transmitted between the upper and lower creasing elements 25,27 such that creasing elements 25,27 rotate reciprocally in opposite directions, that is when one element rotates in a clockwise direction the other rotates in an anti-clockwise direction, and vice versa. This drives the creasing elements 25,27 in the same linear direction. The slots 51,53 enable the lower creasing element 27 to move vertically with respect to the upper creasing element 25 under the driving action of the rocker arms 44.

During operation, the lower portion of each rocker arm 44 is moved by a specified offset by the eccentric cam 42. The sliding pivot pin 46 causes the upper portion of each rocker arm 44 to swing in the opposite direction of the lower portion. In addition to this swing, and due to the sliding motion of the pivot pin 46, the upper end of the rocker arm 44 circumscribes a predefined profile that enables the lower creasing element 27 to rise and fall along a curved path, wherein due to the geometry of the path the lower creasing element 27 interferes with the sheet 11 at the height of the path for approximately 30 degrees of rotation of the drive shaft 38.

The upper creasing element 25 is driven by way of the upper guide element 39 and its sliding pivot pin 56 located in slot 54. This maintains a permanent speed match between the upper and lower creasing elements 25,27. The upper creasing element has a fixed pivot pin 37 and therefore moves along an arcuate path in a reciprocating fashion and interacts with the lower creasing element 27 within the 30 degree period of interference with the sheet in order to produce a crease in the sheet 11.

The microprocessor control system 7 controls the operation of the transportation mechanism 3 and the creasing mechanism 5 so as to match the speed of the creasing elements 25,27 to the speed of the sheet 11 during the creasing operation. At other times, the creasing elements 25,27 can move at a different speed from the sheet 11. The control system 7 includes a user interface 60 that enables a user to input the paper size, the number of creases required and the position of each crease from the leading edge of the sheet. The control system 7 uses this information to calculate the required sheet speed and hence the speed at which it needs to operate the transportation stepper motor 13 and the speed at which it needs to operate the creasing mechanism stepper motor 30 such that at the time the crease is made the speed of the creasing elements 25,27 in the direction of movement of the sheet 11 is matched to the speed of the sheet 11.

For each crease to be formed, the drive shaft 38 performs one complete revolution.

To assist the control system to match the speeds, the drive system 28 includes an optical sensor 58 and a slotted disc 64. The optical sensor 58 is arranged to detect the rotational position of the slotted disc 64 such that a start position can be detected by the microprocessor control system 7. This enables the control system 7 to determine when a creasing operation has been completed and ensures that the drive shaft 38 has returned to the start position ready for the next crease. This, together with the creasing requirements entered by the user, enables the control system 7 to calculate whether it is necessary to stop the creasing mechanism stepper motor 30 from rotating for a period, for example if only one crease is required or if there is sufficient distance between the creases the stepper motor 30 may be stopped, or whether it is necessary to slow the speed of the sheet 11 if the distance between the creases is small. It also enables the control system 7 to determine the rate at which the creasing machine stepper motor 30 needs to be accelerated so that the speed of the creasing elements 25,27 can be matched to the speed of the sheet 11 at the critical time.

A second signal from the sensor 58 is used to confirm the crease point during the operation of the creasing mechanism 5.

Operation of the creasing machine will now be described with reference to FIGS. 7 to 14, which show the movement of the creasing elements 27,27 during a creasing operation.

During set-up, the operator enters the positions of each of the creases in the microprocessor control system 7, using the interface 60. The microprocessor control system 7 can store all of the required crease positions. For most practicable machines and creasing applications the control system 7 will have 5 to 15 separate memory locations for storing crease positions. Preferably the system has nine separate memory locations.

A sheet 11 of flexible material such as paper or card is fed from a feed system into the nip between the input rollers 9*a*, which then take over transport of the sheet 11 from the feed system. Immediately the leading edge of the sheet exits from the input rollers 9*a* it is sensed by the infrared sensor 15. The signal from the sensor 15 is recorded by the microprocessor 7. At this point, the sheet 11 is considered to be registered and throughout its continuing journey through the machine its exact position is always known since the microprocessor accurately controls the speed of the sheet 11.

Figure 7:
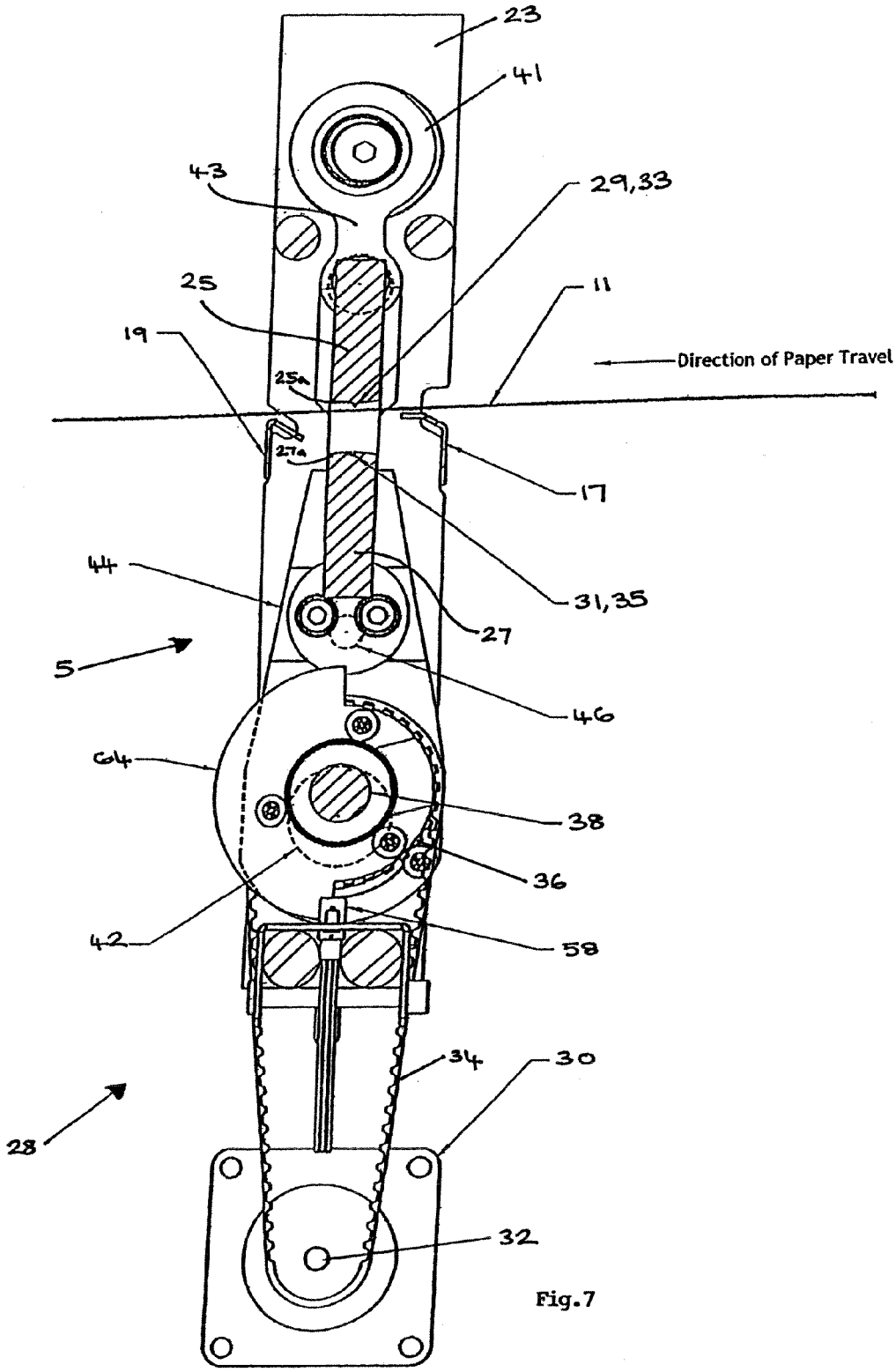
Figure 8:
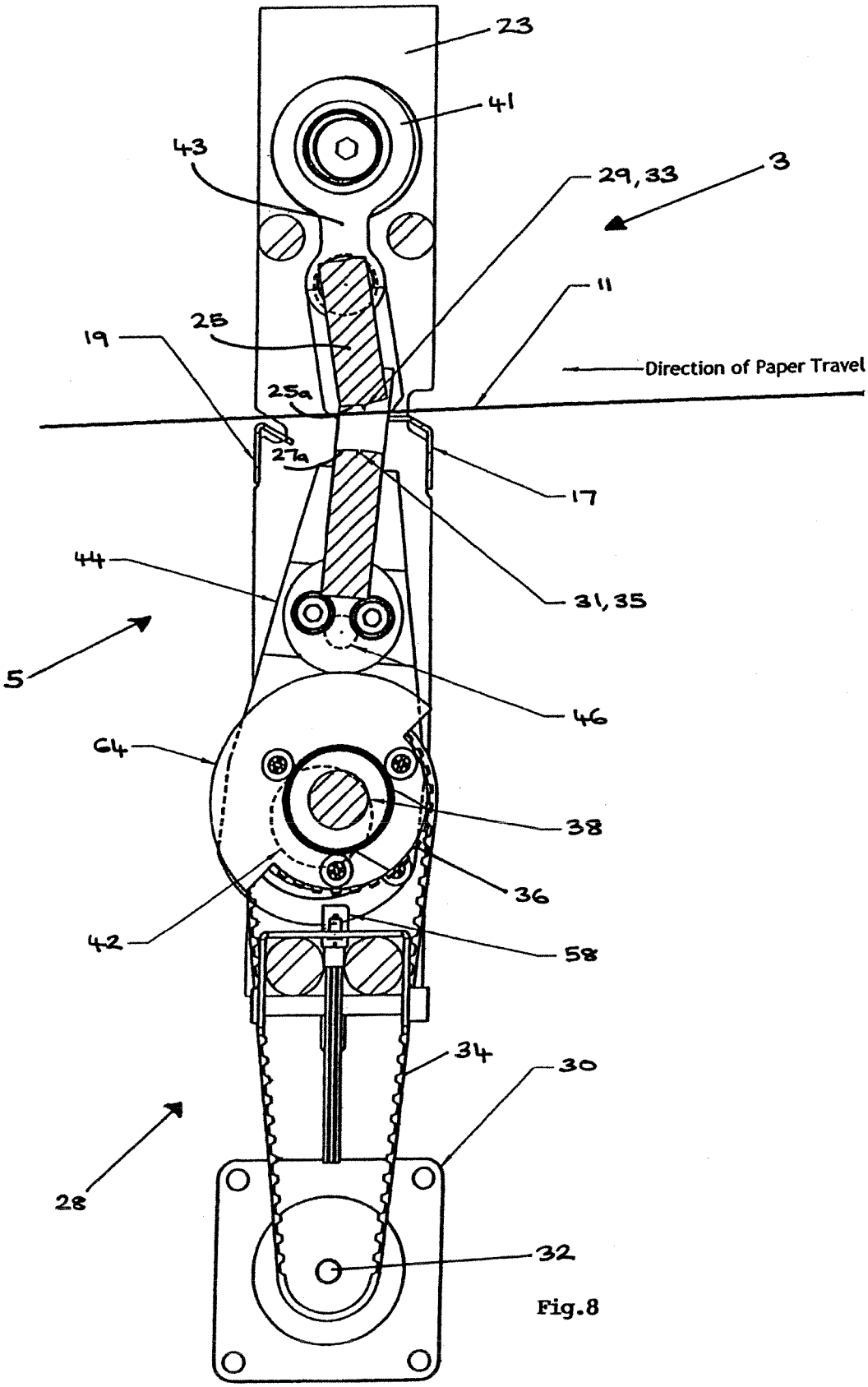
Figure 9:
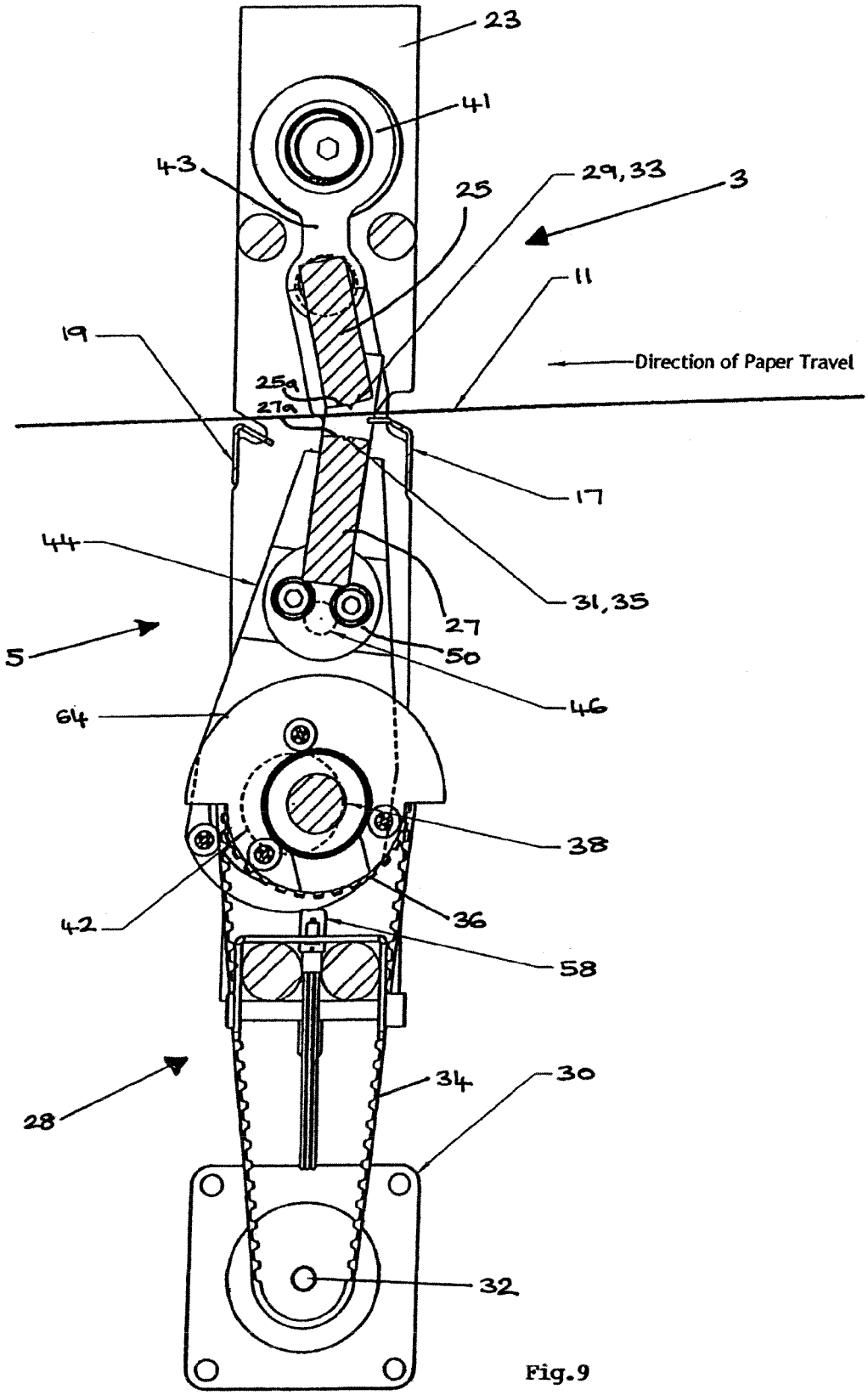
Figure 10:
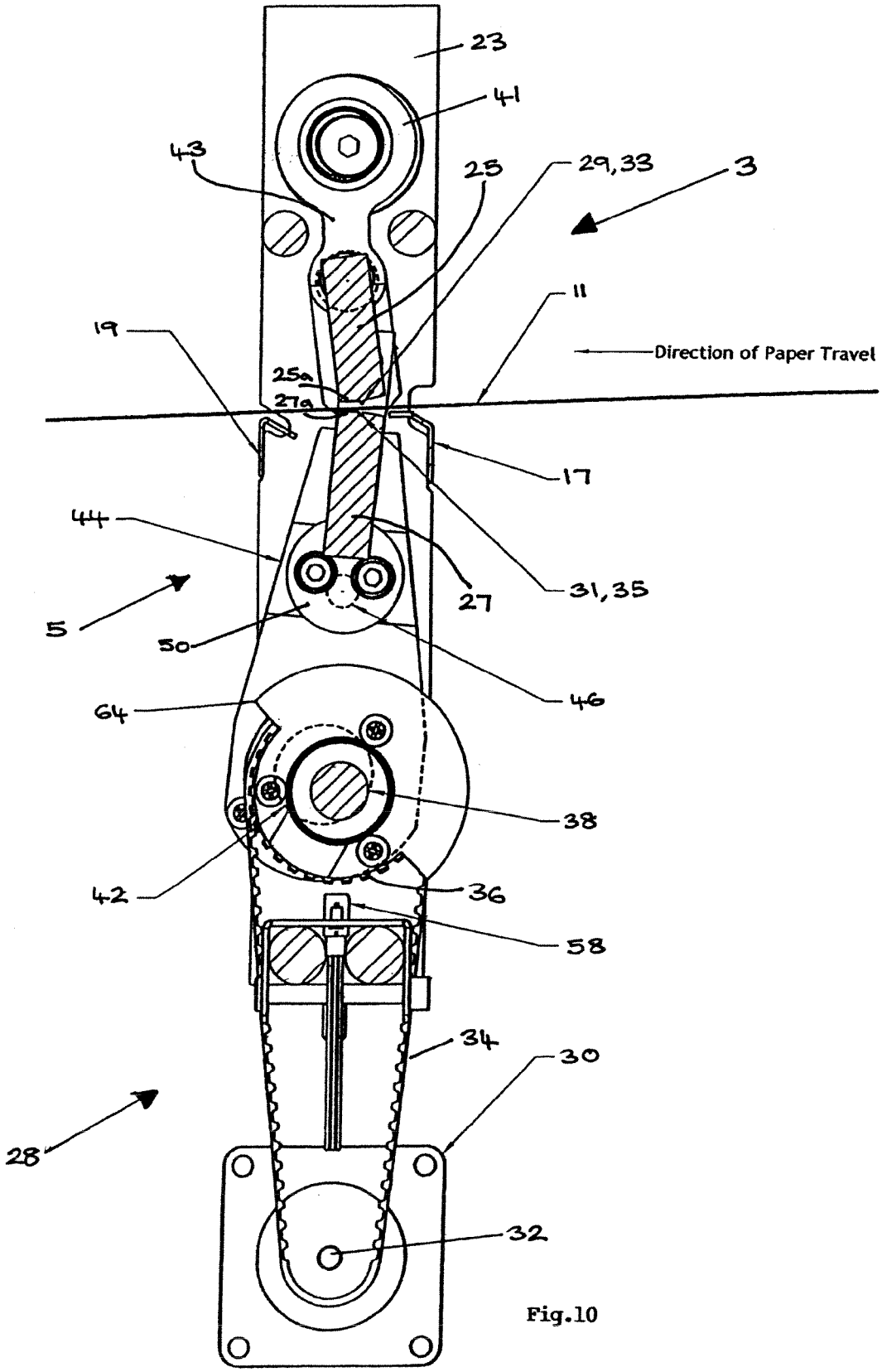
Figure 11:
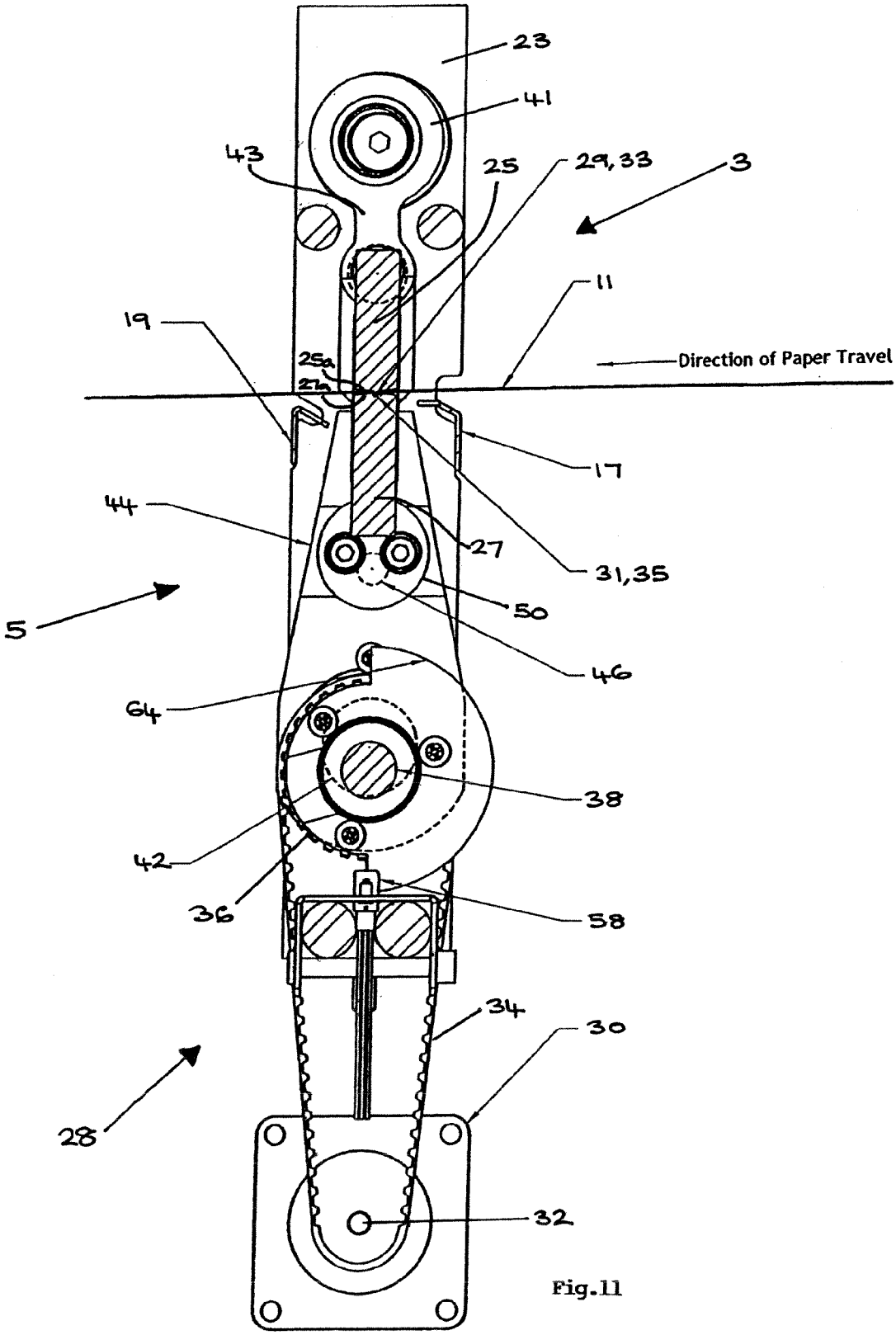
Figure 12:
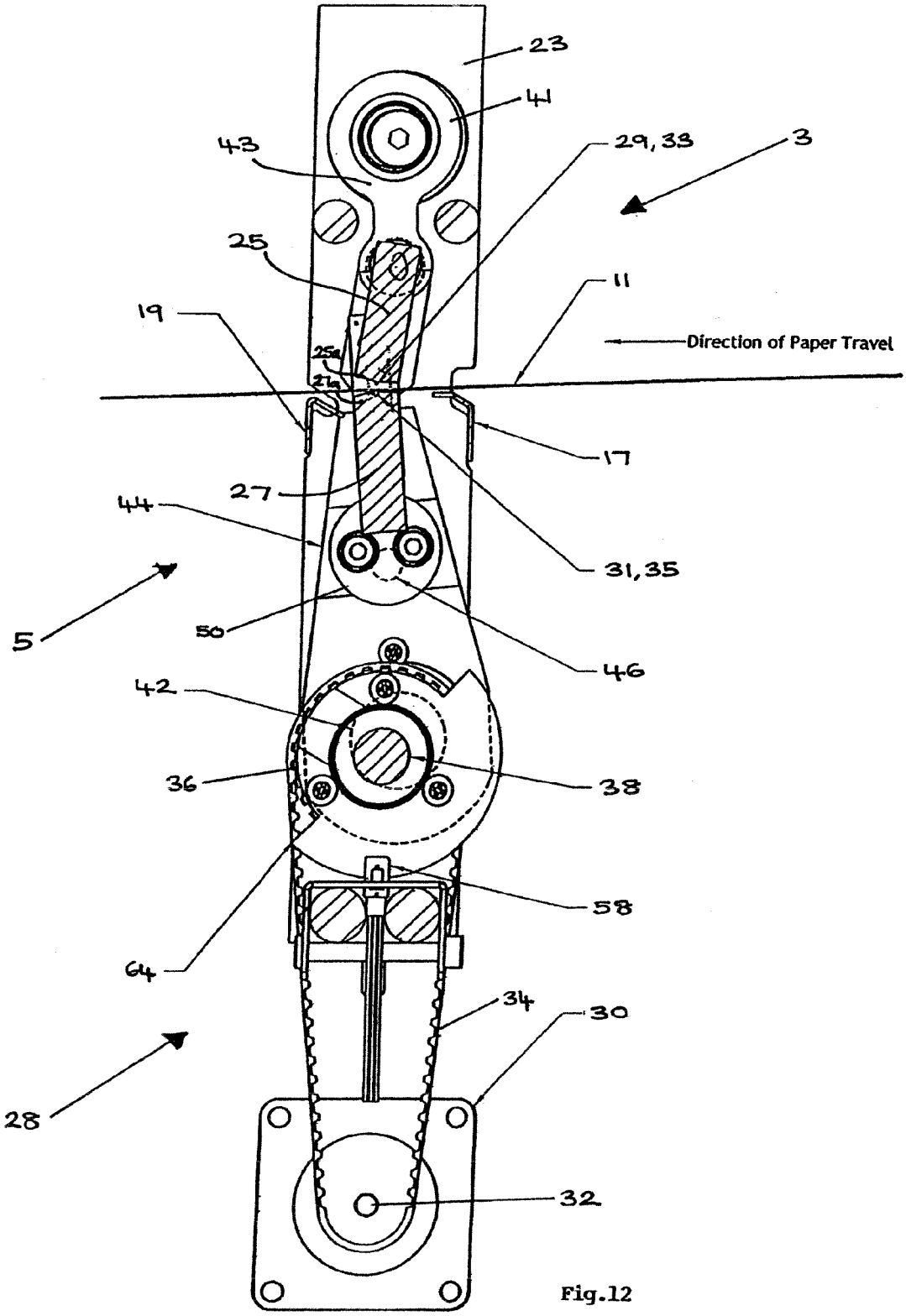
Figure 13:
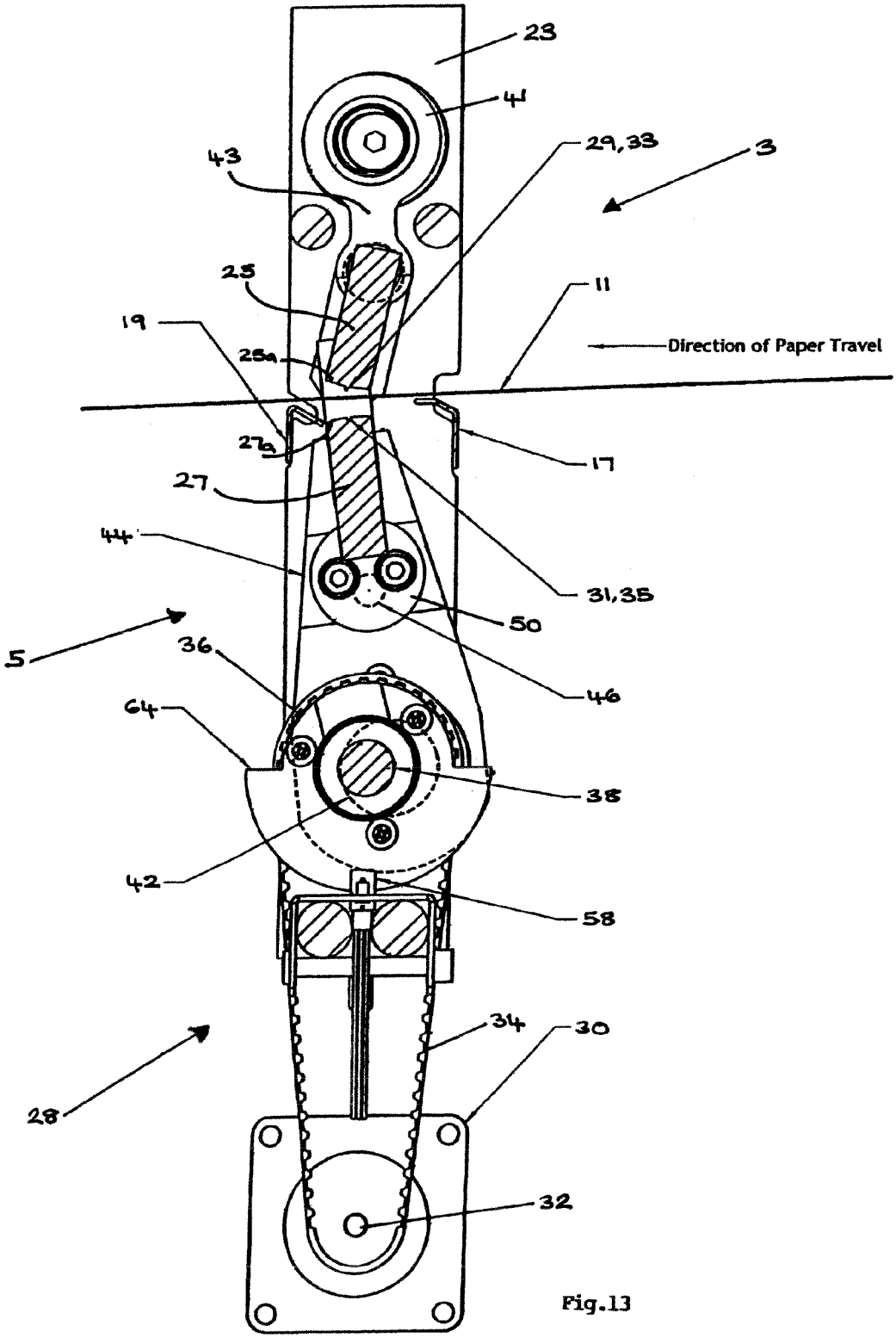
Figure 14:
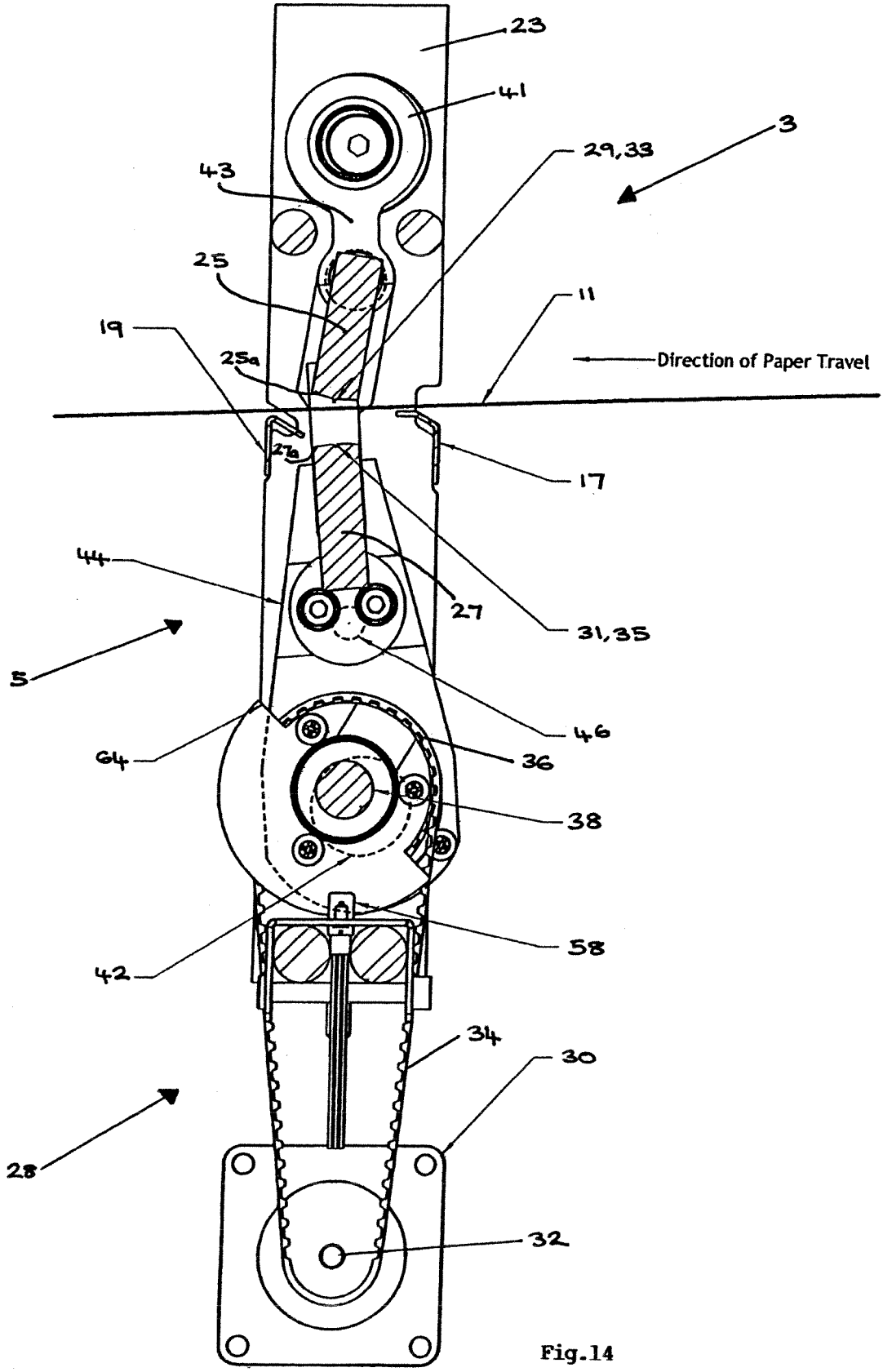

The creasing elements 25,27 start in the home position, wherein they are arranged substantially vertically and are spaced apart by a maximum distance with the lower creasing element 27 in its lowest position (see FIG. 7). At a predetermined position after the input sensor 15 has detected the leading edge of the sheet, the creasing mechanism 5 is activated by the control system 7. The creasing machine stepper motor 30 accelerates at a rate such that creasing elements 25,27 are at the correct linear speed to make the crease in the sheet where the crease is required. Initially the creasing elements 25,27 swing in the direction opposite to the direction of movement of the sheet 11 and the lower creasing element 27 moves upwards towards the sheet 11. After 90 degrees of rotation of the drive shaft 38, the creasing elements 25,27 have reached the limit of their movement in the direction opposite to the direction of travel of the sheet, which is typically in the range of 5 to 30 degrees from the home position (see FIG. 9). In the example shown in FIG. 9 the maximum extent of pivoting movement of the creasing elements is around 15 degrees from the home position. Further rotational movement of the drive shaft 38 causes the creasing elements to change direction and to move in the direction of travel of the sheet 11 (see FIG. 10). At around 20 degrees from the creasing formation (after around 160 degrees of rotation of the drive shaft 38) the linear speed of the creasing elements 25,27 is matched to the linear speed of the sheet 11 in the direction of movement of the sheet and the control system 7 electronically locks the speed of the sheet 11 with the speed of the creasing elements 25,27 for approximately 40 degrees of rotation of the drive shaft 38.

At around 15 degrees from the creasing formation (after around 165 degrees of rotation of the drive shaft 38) the lower creasing element 27 engages the sheet 11 from below. After 180 degrees of rotation the creasing elements 25,27 form the crease in the sheet 11 (typically to within an accuracy of 0.1 mm). At this stage the creasing elements 25,27 are substantially vertical and the distance between them is at a minimum (see FIG. 11). Since the speed of the creasing elements is matched to the speed of the sheet there is no need to stop the movement of the sheet 11 in order to make the crease. This is significantly faster than for traditional machines wherein it is necessary to first stop the movement of the sheet 11 before making the crease.

After approximately a further 15 degrees of rotation of the drive shaft 38 the lower creasing element 27 loses contact with the sheet. After around 5 degrees additional rotation of the drive shaft 38 the control system 7 uncouples the speed of the creasing elements 25,27 from the speed of the sheet 1. The drive shaft 38 continues to rotate and the creasing elements 25,27, reach the limit of their extent of movement in the direction of movement of the sheet, which is typically in the range 5 to 30 degrees from the home position, after 270 degrees of rotation of the drive shaft 38 (see FIG. 13). In the example shown in FIG. 13 the maximum extent of pivoting movement of the creasing elements 25,27 is around 15 degrees from the home position. Further rotation of the drive-shaft 38 causes the creasing elements 25,27 to reverse direction and move towards the home position. The creasing operation is completed after the drive shaft has completed one full revolution and the creasing elements 25,27 have returned to the home position (see FIG. 7).

At this stage, the control system 7 determines whether there is another crease to be made and calculates the necessary speed of rotation of the creasing machine stepper motor 30. For example, the drive shaft 38 may be stopped from rotating for a period if the distance between the first and second creases is larger than the effective circumference of the creasing elements 25,27. Alternatively, the drive shaft 38 may not stop at all but may continue rotating at the necessary speed to arrive in time to make the second crease for example if the spacing is shorter than the effective circumference of the creasing elements 25,27. In this instance, the drive shaft 38 is decelerated as it approaches the indexing (home) position and is then accelerated thereafter. If the distance between the creases is small, the control system 7 can reduce the speed of the transportation system 3 to provide the creasing mechanism with sufficient time to reach the second crease point.

The inventor has found that having creasing elements 25,27 with an effective diameter of around 12 mm enables a minimum crease separation of around 6 mm.

The above procedure is carried out for subsequent sheets 11 fed to the creasing mechanism 5.

It will be apparent to the skilled person that modifications can be made to the embodiment described above that are within the scope of the current invention. For example, the upper creasing element 25 can be driven by the eccentric cam in order to move translationally and pivotally, with the lower creasing element 27 being arranged for pivoting movement only. This is the reverse of the embodiment described above. Also, it is possible to have both the upper and lower creasing elements 25,27 driven by the eccentric cam drive system such that both elements perform pivoting and translational movement similar to the lower creasing element described above.

Alternative sensors can be used for detecting when the creasing elements are in the home position, for example magnetic sensors such as hall-effect sensors or ultrasonic sensors. Any suitable type of sensor can be used.

The invention claimed is:

1. A creasing machine for forming creases in sheets of flexible material, said creasing machine comprising: a creasing mechanism, a transport mechanism for transporting associated sheets of material through the creasing mechanism, and a control system for controlling operation of the creasing mechanism and the transport mechanism, said creasing mechanism including first and second creasing members and a drive system for driving the first and second creasing members, said first and second creasing members are arranged to move in the direction of movement of the associated sheet at a time when the associated sheet is creased and the second creasing member is moveable towards the first creasing member to produce a crease in the associated sheet located between those members, said control system is arranged to substantially match the speed of movement of the first and second creasing members with the speed of the associated sheet to enable the associated sheet to be creased while moving, and wherein the drive system is arranged to move the second creasing member in a translational reciprocating manner and a pivotal reciprocating manner during a creasing operation.

2. A creasing machine according to claim 1, wherein the drive system is arranged to move the first creasing member in a pivotal reciprocating manner during a creasing operation.

3. A creasing machine according to claim 2, wherein the first creasing member includes a first creasing formation and the drive system is arranged to drive the first creasing member such that it moves the first creasing formation along a substantially arcuate path.

4. A creasing machine according to claim 1, wherein the second creasing member includes a second creasing formation and the drive system is arranged to drive the second creasing member such that the second creasing formation moves along a substantially circular or elliptical path.

5. A creasing machine according to claim 2, wherein the drive system is arranged to move the first creasing member in a translational reciprocating manner during the creasing operation.

6. A creasing machine according to claim 1, wherein the drive system is arranged to move the first and second creasing members such that the angular displacement of the first creasing member is matched to the angular displacement of the second creasing member.

7. A creasing machine according to claim 6, wherein the first and second creasing elements are connected together by a sliding pivot arrangement.

8. A creasing machine according to claim 1, wherein the drive system is arranged to move the second creasing member from a start position wherein the separation between the first and second creasing members is at a maximum to a creasing position wherein separation between the first and second creasing members is at a minimum, and then back to the start position.

9. A creasing machine according to claim 1, wherein the first and second creasing members are pivotally mounted.

10. A creasing machine according to claim 9, wherein the first creasing member is arranged to pivot about a fixed pivot axis.

11. A creasing machine according to claim 9, wherein at least one of the first and second creasing members is arranged to pivot about a movable pivot axis.

12. A creasing machine according to claim 1, wherein the drive mechanism includes a variable speed motor.

13. A creasing mechanism according to claim 1, wherein the drive system includes a drive crank and a pair of drive members mounted on the crank, and the drive crank is arranged to drive the first and second creasing members via the drive members.

14. A creasing machine according to claim 13, wherein each drive member is attached to a frame member in a manner that allows it to rotate relative to the frame member and move translationally relative thereto.

15. A creasing machine according to claim 1, wherein the control system is arranged to match the speed of movement of the creasing members with the speed of the associated sheet for a period of movement and controls the speed of the creasing members and the associated sheet independently of each other at other times.

16. A creasing machine according to claim 1, wherein the drive system includes a sensor device for detecting when the creasing members are located at the home position.

17. A creasing machine according to claim 1, wherein the transportation system includes a transport drive motor and a pair of input rollers for transporting associated sheets of material through said creasing mechanism.

18. A creasing machine according to claim 1, wherein the transportation system includes a sensor device for sensing the leading edge of an associated sheet as it passes between said input rollers, said control means is connected to the sensor device and is arranged to receive signals therefrom.

19. A creasing machine according to claim 18, wherein said sensor device is an optical or an ultrasonic sensor.

20. A creasing machine according to claim 18, including a pair of output rollers for removing associated sheets of material from said creasing mechanism.

21. A creasing machine according to claim 20, wherein said input and output rollers are constructed and arranged to be driven synchronously.

22. A creasing machine according to claim 1, wherein the control system is programmable, and is constructed and arranged to control the placing and number of creases produced by the machine according to predetermined requirements.

23. A method of creasing sheets of flexible material by using a creasing machine comprising a creasing mechanism including first and second creasing members and a drive mechanism for driving the creasing members, said method comprising: transporting a sheet of flexible material to the creasing mechanism with a transport mechanism, controlling operation of the creasing mechanism and the transport mechanism with a control system such that the first and second creasing members move in the direction of movement of the sheet at a time when the sheet is creased and said second creasing member moves towards the first creasing member to produce a crease in the sheet located between those members, said control system substantially matching the speed of the first and second creasing members with the speed of the sheet to enable the sheet to be creased while moving, and the drive system moving the second creasing member in a translational reciprocating manner and a pivotal reciprocating manner during the creasing operation.

24. A method according to claim 23, including moving the first and second creasing members along curved paths.

25. A method according to claim 24, wherein the first creasing member includes a first creasing formation and the method includes moving the first creasing formation along a substantially arcuate path.

26. A method according to claim 24, wherein the second creasing member includes a second creasing formation and the method includes moving the second creasing formation along a substantially circular or elliptical path.

27. A method according to claim 23, including moving the first creasing member in a pivotally reciprocating manner during a creasing operation.

28. A method according to claim 27, including moving the first creasing member in a translationally reciprocating manner during a creasing operation.

29. A creasing machine according to claim 28, wherein the drive system is arranged to move at least one of the first and second creasing members in a translational reciprocating manner during a creasing operation.

30. A creasing machine according to claim 28, including a support frame wherein the drive system includes a drive crank and a pair of drive members that are attached to the support frame via a sliding pivot arrangement and the drive system uses the drive members to drive the first and second creasing members via the drive members.

31. A method according to claim 23, including moving the first and second creasing members such that the angular displacement of the first creasing member is matched to the angular displacement of the second creasing member.

32. A method according to claim 23, wherein the creasing machine comprises a creasing mechanism, a transport mechanism for transporting sheets of material through the creasing mechanism, and a control system for controlling operation of the creasing mechanism and the transport mechanism, said creasing mechanism including first and second creasing members and a drive system for driving the first and second creasing members, wherein the first and second creasing members are arranged to move in the direction of movement of the sheet and at least one of said first and second creasing members is moveable towards the other of the first and second creasing members to produce a crease in a sheet located between those members, and wherein the control system is arranged to substantially match the speed of movement of the first and second creasing members with the speed of the sheet to enable the sheet to be creased while moving.

33. A creasing machine for forming creases in associated sheets of flexible material, said creasing machine comprising a creasing mechanism, a transport mechanism for transporting associated sheets of material through the creasing mechanism, and a control system for controlling operation of the creasing mechanism and the transport mechanism, said creasing mechanism comprising first and second creasing members and a drive system for driving the first and second creasing members, said first and second creasing members are arranged to move in the direction of movement of an associated sheet and at least one of said first and second creasing members is moveable towards the other creasing member to produce a crease in an associated sheet located between those members, said control system is arranged to substantially match the speed of movement of the first and second creasing members with the speed of an associated sheet when creasing the associated sheet to enable the associated sheet to be creased while moving, and wherein the first and second creasing members are pivotally mounted relative to respective pivots and the drive system is arranged to drive each of the first and second creasing members in a pivotally reciprocating fashion about their respective pivots during a creasing operation.

34. A creasing machine according to claim 33, wherein the drive system is arranged to move each of the first and second creasing members in a translational reciprocating manner during a creasing operation.

* * * * *